US006012589A

United States Patent [19]

Schulze

[11] Patent Number: 6,012,589

[45] Date of Patent: Jan. 11, 2000

[54] APPARATUS FOR AND SORTING OF BANK NOTES

[75] Inventor: Manfred Schulze, Tulln, Austria

[73] Assignee: AS Beteiligungs Gesellschaft m.b.H., Austria

[21] Appl. No.: 08/945,040

[22] PCT Filed: Feb. 17, 1997

[86] PCT No.: PCT/AT97/00028

§ 371 Date: Oct. 21, 1997

§ 102(e) Date: Oct. 21, 1997

[87] PCT Pub. No.: WO97/31341

PCT Pub. Date: Aug. 28, 1997

[30] Foreign Application Priority Data

Feb. 22, 1996 [AT] Austria ..... 91/96 U

[51] Int. Cl.[7] ..... B07C 5/00

[52] U.S. Cl. ..... 209/534; 209/656; 209/900; 271/225

[58] Field of Search ..... 209/534, 656, 209/900; 271/225

[56] References Cited

U.S. PATENT DOCUMENTS

| | | | |
|---|---|---|---|
| 4,381,447 | 4/1983 | Horvath et al. | 250/223 R |
| 4,499,834 | 2/1985 | Ruetschle et al. | 209/656 X |
| 4,718,560 | 1/1988 | Kiriake | 209/656 |
| 5,258,045 | 11/1993 | Yamashita | 271/225 |
| 5,358,234 | 10/1994 | Boriani et al. | 271/225 |

FOREIGN PATENT DOCUMENTS

| | | |
|---|---|---|
| 33 03 699 A1 | 8/1983 | Germany . |
| 2 106 080 | 4/1983 | United Kingdom . |
| 2 196 323 A1 | 4/1988 | United Kingdom . |

*Primary Examiner*—Tuan N. Nguyen
*Attorney, Agent, or Firm*—Nixon & Vanderhye P.C.

[57] ABSTRACT

In an arrangement for separating and sorting bank notes, including a feeder shaft and a transporting means for separated bank notes, the transporting means is comprised of parallel recirculating continuous conveyor belts. One of the two continuous conveyor belts is returned via a deflection or guide pulley. The upper continuous conveyor belt, which is kept running, is guided in an upward excursion from a substantially horizontal running direction. A reversibly drivable sorting roller is arranged in the transport path of the bank notes in the vicinity of the deflection or guide pulley for the returned continuous conveyor belt, viewed in the transport direction, which reversibly drivable sorting roller continues to convey the bank notes as the upper continuous conveyor belt is driven in the transport direction and causes the bank notes to be diverted and introduced into a shaft or bin provided below the path of movement of the upper continuous conveyor belt as it is driven in opposite direction. At least two reversibly drivable sorting rollers are arranged in the transport direction of the upper continuous conveyor belt.

10 Claims, 1 Drawing Sheet

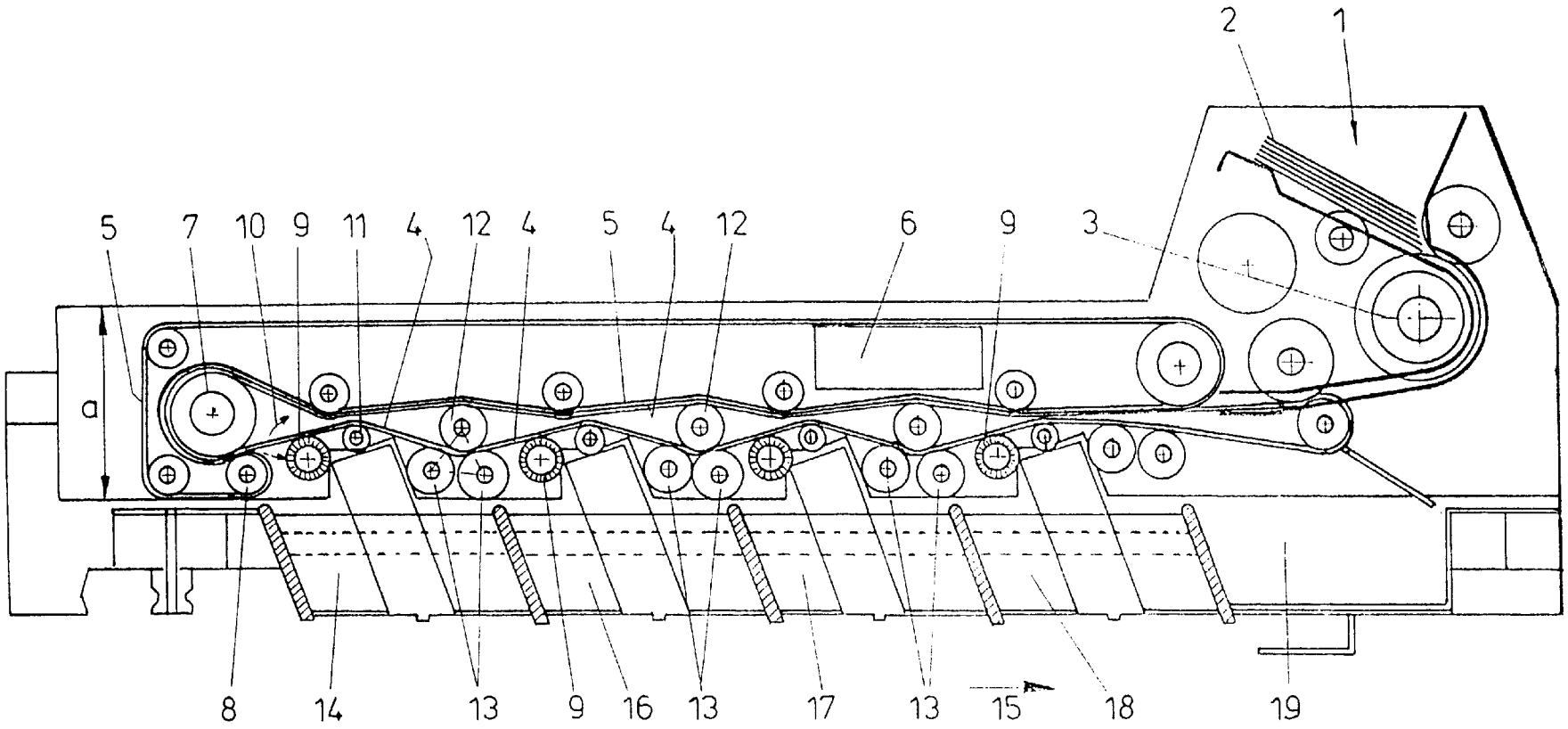
1
2
3
9
6
12
4
5
4
12
4
11
9
10
7
5
a
19
18
15
13
17
13
16
9
13
14
8

APPARATUS FOR AND SORTING OF BANK NOTES

BACKGROUND

The invention relates to an arrangement for separating and sorting bank notes, including a feeder shaft and a transporting means for separated bank notes. A number of mechanic devices in which bank notes are withdrawn from different stacks while applying a suction pressure and are deposited in a common dispensing unit have already been proposed for delivering different bank notes. Usually, pivotable flaps are used for separating, appropriately diverting the flow of bank notes to be separated.

From U.S. Pat. No. 5,258,045 an arrangement for sorting sheets is known, in which a sheet reaches a pair of pressing rollers via a feeding shaft. The rollers are arranged in a manner that the line connecting their axes of rotation is inclined with respect to a line which is perpendicular to the sheet feeding shaft. The pressing rollers are reversibly drivable, thereby enabling sorting by means of a preceding identification device on account of the different sense of rotation. During further transport, that arrangement requires the reversal of the moving direction and hence a high mechanical stress to be exerted on the article to be sorted.

SUMMARY OF THE INVENTION

The invention aims at providing an arrangement of the initially defined kind, which can be constructed in a particularly flat manner thus offering the opportunity of being placed, even by way of addition, on suitable drawers intended to receive different adjacently arranged bank notes. Above all, the configuration according to the invention, despite its extremely flat mode of construction, is to offer the possibility of ensuring the safe storage in at least one intermediate storage, which itself may be designed in the form of a drawer, in a quick and reliable manner also in cooperation with a bank note authentication and identification means such that subsequent manual counting of the notes intermediately received in the intermediate storage will still be feasible it a depositor objects to the counted and sorted amount as being incorrect. To solve this object, the arrangement according to the invention, of the initially defined kind substantially consists in that the transporting means is comprised of parallel recirculating continuous conveyor belts, that one of the two continuous conveyor belts is returned via a deflection or guide pulley, that the upper continuous conveyor belt, which is kept running, is guided in an upward excursion from a substantially horizontal running direction, that a reversibly drivable sorting roller is arranged in the transport path of the bank notes in the vicinity of the deflection or guide pulley for the returned continuous conveyor belt, viewed in the transport direction, which reversibly drivable sorting roller continues to convey the bank notes as the upper continuous conveyor belt is driven in the transport direction and causes the bank notes to be diverted and introduced into a shaft or bin provided below the path of movement of the upper continuous conveyor belt as it is driven in opposite direction, and that at least two reversibly drivable sorting rollers are arranged in the transport direction of the upper continuous conveyor belt. By the fact that the transporting means is comprised of parallel recirculating continuous conveyor belts, the stack of notes can be inserted in a receiving hopper and, upon deflection, is directed from the receiving hopper into a substantially horizontal path. In this transport path, the separated notes already are disposed one after the other in the running direction and may be identified and authenticated on a suitable point. By the fact that one of the two continuous conveyor belts is returned via a deflection or guide pulley and the upper continuous conveyor belt, which is kept running, is guided in an upward excursion from a substantially horizontal running direction, the respective bank note transported to that point is further conveyed in a substantially horizontal running direction, getting onto the upper surface of a consecutively arranged sorting roller. By the fact that a reversibly drivable sorting roller is provided in the transport path of the bank notes in the vicinity of the deflection or guide pulley for the returned continuous conveyor belt, viewed in the transport direction, it has become feasible to ensure any desired elimination from further transport in a particularly simple and quick manner, it being sufficient to switch the drive of the sorting roller in a direction opposite to the transport direction of the conveyor belt. In that case, a bank note guided substantially horizontally and substantially radially onto the upper surface of the sorting roller is set in a downward excursion, wherein driving in opposite direction causes the deflection and introduction of the bank notes into a shaft or bin provided below the path of movement of the upper continuous conveyor belt. It is only by driving in same direction that the bank note will again be moved in the direction of the upper conveyor belt and, due to inertia and contact with the upper continuous conveyor belt forced by this movement, again gets into the conveying direction and is further conducted in the same. Thus, sorting of the bank notes is feasible by rapidly reversing the drive, wherein at least two reversibly drivable sorting rollers are arranged in the transport direction of the upper continuous conveyor belt in order to enable appropriate sizing in a suitable manner. On account of the extremely flat mode of construction due to the substantially horizontal conveying direction of the continuous conveyor belts, intermediate storage may be effected in a container designed as a drawer and provided below the path of movement of the continuous belt such that, in case of reclamations, the intermediate storage in the form of a drawer may simply be pulled out or moved out in order to recount the notes manually.

In an advantageous manner, the configuration according to the invention is devised such that the upper continuous conveyor belt is conducted upwardly in front of the first sorting roller and downwardly behind the first sorting roller, whereupon, after further upward deflection of the upper conveyor belt, the bank notes that have not yet been sorted out are conducted towards the upper surface of at least one further reversible sorting roller. By the fact that the running direction of the continuous conveyor belt in this manner substantially follows a zig-zag course, a substantially horizontal delivery direction of the further transported bank note is again ensured immediately in front of the consecutively arranged sorting roller such that the bank note again gets onto the consecutive sorting roller in a substantially radial manner. Sorting out or storage of the bank note, or further transportation of the same, is again rendered feasible by simple reversion of the drive. The bank note with the zig-zag guidance of the upper continuous conveyor belt may be supported by suitable rollers in order to safeguard suitable acceleration and hence safe further transport.

To this end, the configuration advantageously is devised such that further deflection of the upper continuous conveyor belt is realized by a roller combination comprising pressure and supporting rollers, the continuous conveyor belt being directed upwards in a direction in which a gap remains between the jacket of the sorting roller and the continuous conveyor belt, wherein, due to the fact that a gap is to remain between the jacket of the sorting roller and the continuous conveyor belt, the wear of the sorting roller may be minimized while, at the same time, considerably increasing the speed at which the directions of rotation of the sorting rollers may be reversed. The extremely flat mode of construction of the overall arrangement is enhanced by journalling the reversible sorting rollers neighbouring in the conveying direction so as to be rotatable in a common plane, very little space in the height direction each being used for the excursion of the upper continuous conveyor belt.

In order to ensure, by this simple arrangement, the rejection of bank notes that have, for instance, not been reliably identified or been recognized as defective, the configuration advantageously is devised such that a rigid deflection means for bank notes that have been conveyed further at a rotary drive in same direction of the preceding sorting rollers is arranged to follow the sorting roller provided last in the conveying direction, said deflection means having a reception means arranged therebelow. Any bank notes for which an appropriate excursion signal by reversing the direction of rotation of sorting rollers has not been provided are conveyed as far as to the end of the transport path, automatically getting into the storage provided for not clearly identified or defective bank notes.

The control of the reversible drives may be coupled with a bank note identification means in a simple manner. Advantageously, the configuration in that case is devised such that each respective separate rotation drive of the sorting rollers consecutively arranged in the conveying direction is connected with a controlling means to which the signals of a bank note identification and authentication means are fed.

With a view to maintenance work or in case of failure, the configuration in a particularly advantageous manner may be devised such that the conveying means is arranged in a frame that is extractable in the manner of a drawer, wherein access to already deposited bank notes can be prevented during such maintenance work or failure. In this manner, the operating safety of the arrangement is substantially enhanced.

The fact that the containers provided below the path of movement are designed as neighbouring bins of a drawer, as in accordance with a preferred further development of the arrangement according to the invention, with the drawer comprising an openable bottom and/or an openable side wall via which the sorted bank notes may be discharged into bins or shafts located therebelow or laterally thereof for sorted storage, offers the opportunity of a secondary check after the first automatic and machine counting and storage. In case of reclamation it will do to pull out, or move out, the drawer provided therebelow such that the just read-in bank notes seized by the arrangement for separating and sorting the bank notes are still available unchanged. Even at this operation no free access to bank notes lying underneath and already securely deposited is provided such that the operating safety remains fully guaranteed.

Further discharging of bank notes intermediately deposited in the bins of the drawer may be effected in a particularly simple manner in that the drawer comprising the bins for the sorted reception of the bank notes includes at least one open or openable side wall via which at least one manipulator including at least one pick-up transports off the bank notes contained in the respective bin of the drawer. In this manner, further access to the bank notes after having emptied the bins of the drawer is no longer possible, and also subsequent actuation of the drawer for the purpose of opening the drawer will not enable the access to already deposited notes. In order to increase the speed of deflection while simultaneously saving the sorting rollers and the bank notes, the configuration advantageously is devised such that the sorting rollers are enveloped by a rough jacket of elastic material, for instance sponge rubber. The arrangement according to the invention in a simple manner may be adapted to, and mounted on, a great number of money storage installations by way of addition, wherein such subsequent mounting will not considerably increase the structural height of the overall arrangements.

BRIEF DESCRIPTION OF THE DRAWING

The single drawing FIGURE is a schematic side elevation of an arrangement for sorting and separating banknotes in accordance with the invention.

DETAILED DESCRIPTION OF THE INVENTION

From the drawing a feeder shaft 1 for receiving bank notes 2 is apparent. The bank notes 2 may be of different values and are drawn off individually on the feeder shaft and introduced between two continuous conveyor belts 4 and 5 via a first transport roller 3. In the conveying path of these continuous conveyor belts 4 and 5, a bank note authentication and validation means 6 is provided first. The bank notes, which are held between the continuous conveyor belts 4 and 5 one after the other in the conveying direction, are returned via a rear deflection pulley 7, whereupon the lower continuous conveyor belt 5 is conducted back via a guide or deflection pulley 8. A note thus deprived of its downward support at that point gets onto the upper surface of a first sorting roller 9 in a substantially horizontal direction. If the direction of movement of the sorting roller 9 in the sense of the conveying direction has been chosen according to arrow 10 of the upper continuous conveyor belt 4 remaining there, the bank note is pressed against the surface of the continuous conveyor belt 4 under the action of the centrifugal force and, via a consecutively provided first deflection pulley 11, again reaches a downwardly oriented conveying path. New deflection of the continuous conveyor belt 4 upwardly is effected by a roller combination comprised of pressure rollers 12 and supporting rollers 13, a thus further conveyed bank note again being directed onto the surface of a further consecutively arranged sorting roller 9. This procedure subsequently is repeated with further sorting rollers 9, reference numerals for subsequent deflection means having again been identically chosen.

If the first sorting roller 9 rotates against the direction of arrow 10, a bank note arriving on this sorting roller is diverted in the direction of the shaft or bin 14 located therebelow. This storage 14 is provided in a pull-out drawer to be extracted in the sense of arrow 15, wherein additional shafts 16, 17 and 18 are each adjacently provided, into which bank notes are introduced upon rotation of the preceding sorting roller in the sense of the moving direction 10 of the conveyor belt 4 and rotation of the respectively consecutive sorting roller 9 opposite to the direction of arrow 10.

Bank notes with which all of the sorting rollers 9 have been rotated in the direction of arrow 10 reach a final storage 19 for those bank notes which could not be clearly identified. In doing so, the direction of rotation of the sorting rollers 9 is determined by signals emitted from the bank note validator 6 such that the clear identification of the respective notes and their allocation to the respective storage bins 14, 16, 17 and 18 in the pull-out drawer are feasible. The drawer comprising bins 14, 16, 17 and 18 thus constitutes an intermediate storage and the bank notes conveyed and sorted into this intermediate storage are discharged from bins 14, 16, 17 and 18 by a simple confirmation or input after termination of the read-in and sorting procedure. The bank notes get into a secured area and are no longer freely accessible. In case the read-in and sorted number of bank notes is being contested by a client during the read-in procedure, it will do to move out the drawer in the direction of arrow 15 with all of the read-in and sorted bank notes being available unchanged.

The overall structural height a of the arrangement for separating and sorting bank notes may be kept extremely small and all of the structural components of this arrangement themselves may be mounted within a pull-out carriage capable of being pulled off in the direction of arrow 15. In pulling off the carriage, merely the intermediate storage bins 14, 16, 17 and 18 will become freely accessible such that the already stored bank notes will remain protected in a safe area.

On the whole, an extremely flat-design operationally safe system easy to maintain is provided, in which the safety of the overall arrangement and, in particular, the safety of the already stored bank notes remains fully maintained at any time.

I claim:

1. An arrangement for separating and sorting bank notes comprising a feeder shaft and a transporting means for separated bank notes, wherein said transporting means is comprised of parallel, recirculating continuous conveyor belts arranged to carry the banknotes therebetween; a lower one of said two continuous conveyor belts being returned via a deflection or guide pulley, and an upper one of said two continuous conveyor belts which is kept running, being guided in an upward excursion from a substantially horizontal running direction; a first reversibly drivable sorting roller arranged in a transport path of the bank notes in the vicinity of the deflection or guide pulley for said lower continuous conveyor belt, viewed in a transport direction; and wherein said reversibly drivable sorting roller continues to convey the bank notes as the upper continuous conveyor belt is driven in the transport direction and causes the bank notes to be diverted and introduced into a shaft or bin provided below said upper continuous conveyor belt as it is driven in opposite direction; and further wherein at least two additional reversibly drivable sorting rollers are arranged in the transport direction of the upper continuous conveyor belt.

2. An arrangement according to claim 1, wherein said upper continuous conveyor belt is conducted upwardly in front of the first sorting roller and downwardly behind the first sorting roller, whereupon, after further upward deflection of the upper continuous conveyor belt, the bank notes that have not yet been sorted out are conducted towards an upper surface of one of said at leat two additional reversibly drivable sorting rollers.

3. An arrangement according to claim 1, wherein said first and said additional reversible sorting rollers are journalled so as to be rotatable in a common plane.

4. An arrangement according to claim 1, wherein a rigid deflection means is arranged to follow a last sorting roller provided in the conveying direction, said deflection means having a reception means arranged therebelow.

5. An arrangement according to claim 1, wherein respective drives for said sorting rollers are consecutively arranged in the conveying direction and are connected with a controlling means to which signals of a bank note authentication and validation means are fed.

6. An arrangement according to claim 1, wherein said transporting means is arranged in an extractable frame.

7. An arrangement according to claim 1, wherein containers are provided below said transport path and are provided as adjacent bins of a drawer, the drawer comprising an openable bottom and/or an openable side wall via which the sorted bank notes may be discharged into bins or shafts located therebelow or laterally thereof for sorted storage.

8. An arrangement according to claim 7, wherein said drawer includes at least one open or openable side wall via which at least one manipulator comprising at least one pick-up transports off the bank notes contained in the respective bin of the drawer.

9. An arrangement according to claim 1, wherein said sorting rollers are enveloped by a rough jacket of elastic material.

10. An arrangement for separating and sorting bank notes, comprising a feeder shaft and a transporting means for separated bank notes, wherein said transporting means is comprised of parallel, recirculating continuous conveyor belts arranged to carry the banknotes therebetween; a lower one of said two continuous conveyor belts being returned via a deflection or guide pulley, and an upper one of said two continuous conveyor belts which is kept running, being guided in an upward excursion from a substantially horizontal running direction; a first reversibly drivable sorting roller arranged in a transport path of the bank notes in the vicinity of the deflection or guide pulley for said one lower continuous conveyor belt, viewed in a transport direction and wherein said reversibly drivable sorting roller continues to convey the bank notes as the upper continuous conveyor belt is driven in the transport direction and causes the bank notes to be diverted and introduced into a shaft or bin provided below said upper continuous conveyor belt as it is driven in opposite direction; and further wherein at least two additional reversibly drivable sorting rollers are arranged in the transport direction of the upper continuous conveyor belt; wherein said upper continuous conveyor belt is conducted upwardly in front of the first sorting roller and downwardly behind the first sorting roller, whereupon, after further upward deflection of the upper conveyor continuous belt, the bank notes that have not yet been sorted out are conducted towards an upper surface of one of said at least two additional reversibly drivable sorting rollers said further upward deflection of said upper continuous conveyor belt being realized by a roller combination comprising pressure and supporting rollers, said upper continuous conveyor belt being directed upwards in a direction in which a gap remains between a jacket of the sorting roller and the upper continuous conveyor belt.

* * * * *